US008752313B2

(12) United States Patent
Wilson et al.

(10) Patent No.: US 8,752,313 B2
(45) Date of Patent: Jun. 17, 2014

(54) BLOW SENSOR FOAM NOVELTIES

(71) Applicant: American Greetings Corporation, Cleveland, OH (US)

(72) Inventors: Nicole Wilson, Brunswick, OH (US); Gary Nelson, Avon, OH (US); Anthony Begin, Cleveland, OH (US)

(73) Assignee: America Greetings Corporation, Cleveland, OH (US)

( * ) Notice: Subject to any disclaimer, the term of this patent is extended or adjusted under 35 U.S.C. 154(b) by 0 days.

(21) Appl. No.: 13/647,743

(22) Filed: Oct. 9, 2012

(65) Prior Publication Data

US 2013/0283650 A1 Oct. 31, 2013

Related U.S. Application Data

(60) Continuation-in-part of application No. 13/459,553, filed on Apr. 30, 2012, now abandoned, which is a division of application No. 13/004,544, filed on Jan. 11, 2011, now Pat. No. 8,205,365.

(51) Int. Cl.
*G09F 1/00* (2006.01)

(52) U.S. Cl.
USPC ..... 40/124.02; 40/124.03

(58) Field of Classification Search
USPC ..... 40/124.01, 124.02, 124.03
See application file for complete search history.

(56) References Cited

U.S. PATENT DOCUMENTS 2,736,115 A * 2/1956 James ..... 40/312
2,927,400 A 3/1960 Bailey
4,055,014 A * 10/1977 Schmidt et al. ..... 40/442
5,743,035 A 4/1998 Bradley et al.
5,841,878 A * 11/1998 Arnold et al. ..... 381/124
5,936,521 A 8/1999 Blackman
6,282,819 B1 * 9/2001 Gu ..... 40/124.03
6,357,152 B1 3/2002 Brooks et al.
6,460,277 B1 10/2002 Tower
6,491,516 B1 12/2002 Tal et al.
6,719,443 B2 4/2004 Gutstein et al.
6,845,583 B2 * 1/2005 Lee ..... 40/717
6,848,965 B2 2/2005 Wong
7,025,478 B1 4/2006 Reinecke
7,125,142 B2 10/2006 Wainwright
7,201,402 B2 4/2007 Durprey
7,300,178 B2 * 11/2007 Helou ..... 362/253

(Continued)

OTHER PUBLICATIONS

"Monkey/jungle birthday cake," Kelly the Cake Girl's Blog, http://kellythecakegirl.wordpress.com/2010/04/20/monkeyjungle-birthday-cake/, Apr. 20, 2010.*

*Primary Examiner* — Gary Hoge
(74) *Attorney, Agent, or Firm* — Christine Flanagan

(57) ABSTRACT

Three-dimensional lightweight foam greeting cards are described herein having a foam body with a perimeter wall that extends between two spaced apart parallel pieces of planar sheet material such as heavy gauge paper, cardboard, or other such material. The greeting cards have a partially hollowed foam body or one or more cavities in the foam body concealed in the front and back by the planar sheet material which may be pre-cut in the shape of the foam body are decorated consistent with the design of the foam body. The cavities in the foam body may contain various electronic components that enable the greeting card to produce sound, record and playback a personalized message, trigger light activation, trigger the movement of moveable parts, display digital video, photographs or slideshows, or a combination thereof.

15 Claims, 10 Drawing Sheets

(56) References Cited

U.S. PATENT DOCUMENTS

| | | | | |
|---|---|---|---|---|
| 7,633,232 | B2 | 12/2009 | Wong | |
| 7,634,864 | B2 | 12/2009 | Segan | |
| 8,256,150 | B2 * | 9/2012 | Qiao et al. | 40/124.03 |
| 2007/0109780 | A1 | 5/2007 | Lee et al. | |
| 2007/0153638 | A1 * | 7/2007 | Lebbing | 368/274 |
| 2008/0032587 | A1 | 2/2008 | Krivanek et al. | |
| 2008/0289230 | A1 * | 11/2008 | Mandelbaum et al. | 40/124.01 |
| 2009/0126239 | A1 | 5/2009 | Clegg | |
| 2009/0241387 | A1 | 10/2009 | Wong | |
| 2009/0308931 | A1 * | 12/2009 | Halbur et al. | 235/487 |
| 2010/0270946 | A1 | 10/2010 | Liu et al. | |
| 2010/0287799 | A1 * | 11/2010 | Clegg | 40/124.02 |
| 2011/0074297 | A1 | 3/2011 | Gutstein et al. | |
| 2011/0265356 | A1 * | 11/2011 | Wong | 40/124.02 |
| 2012/0110879 | A1 | 5/2012 | Qiao et al. | |

* cited by examiner

BLOW SENSOR FOAM NOVELTIES

RELATED APPLICATIONS

This application is a continuation-in-part of and claims priority to U.S. patent application Ser. No. 13/459,553, filed on Apr. 30, 3012, which claims priority to U.S. patent application Ser. No. 13/004,544, filed on Jan. 11, 2011. All of the above-referenced patent applications are incorporated herein by reference in their entirety.

FIELD OF THE INVENTION

The present invention relates to greeting cards, and more specifically to three-dimensional foam greeting cards and decorative greeting card accessories.

BACKGROUND OF THE INVENTION

For many years paper greeting cards have been widely used for celebratory occasions such as birthdays, graduations, weddings and other commercial purposes. Traditional text information is generally found on paper greeting cards. More recently, sound has been added to traditional paper greeting cards to increase the personalization of the cards by delivering an audio message that is electronically embodied in circuitry that is carried within the greeting card. The ability to use sound in combination with printed matter such as with conventional printed greeting cards significantly enhances the communicative value of social and relational greetings. The availability of small voice recording sound modules has made sound-generating greeting cards increasingly popular. Small lighting systems have also been incorporated into social greeting products and novelties, and combined in circuits with sound and other features.

SUMMARY OF THE INVENTION

A three-dimensional foam greeting card is described herein, in one embodiment, having a three-dimensional foam body, a first planar surface material attached to a front surface of the three-dimensional foam body, a second planar surface material attached to a back surface of the three-dimensional foam body and a sound module located in a recess in the three-dimensional foam body and concealed by the first and second planar surface material. The sound module may include a speaker, circuit board, integrated circuit, microprocessor, memory device, power source, at least one switch mechanism and at least one pre-loaded digital audio file. The at least one switch mechanism controls playback of the at least one pre-loaded digital audio file.

In another embodiment, the three-dimensional foam greeting card of the present invention contains a three-dimensional foam body having at least one hollowed out portion creating a cavity therein, a first planar surface attached to a front surface of the three-dimensional foam body, a second planar surface attached to a back surface of the three-dimensional foam body, a sound module comprising a speaker, circuit board, integrated circuit, microprocessor, power source, memory device and at least one pre-loaded audio file, a recording device, a first switch to initiate a user recording session, and a second switch to initiate playback of the at least one pre-loaded audio file or a user recorded message.

In still another embodiment, the foam greeting card contains a three-dimensional foam body with a perimeter wall which extends between two spaced apart parallel pieces of heavy gauge planar sheet material, and a multimedia player device located and concealed within the three-dimensional foam body. The multimedia player device may include a circuit board, integrated circuit, microprocessor, speaker, power source, memory device, an electronic display screen operative to display digitally generated images, a data storage device, at least one switch mechanism, and at least one pre-loaded digital audio or video file. The electronic display screen is visible through an opening in the three-dimensional foam body and one of the pieces of heavy gauge planar sheet material.

DETAILED DESCRIPTION OF PREFERRED AND ALTERNATE EMBODIMENTS

The present disclosure and related inventions provide foam constructs in the form of greeting devices, greeting cards, novelties, gifts and foam constructs with functional features, and which can be used in connection with other devices such as retail displays.

Figure 3:
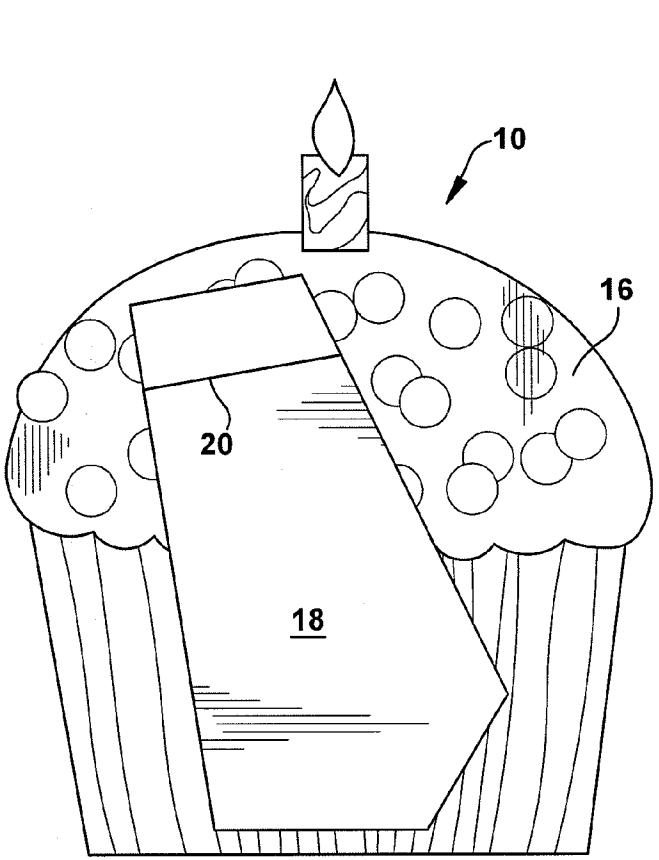
FIG. 3 is a rear view of the three-dimensional foam greeting card of FIG. 1.
Figure 2:
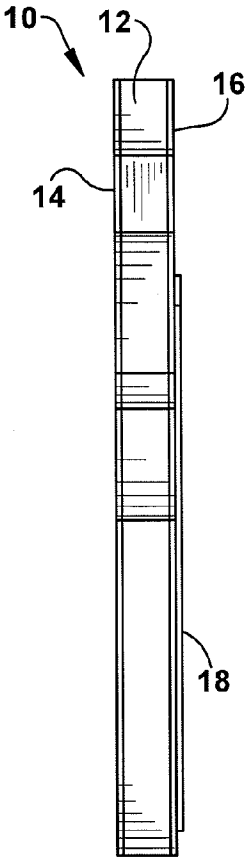
FIG. 2 is a side view of the three-dimensional foam greeting card of FIG. 1.
Figure 9:
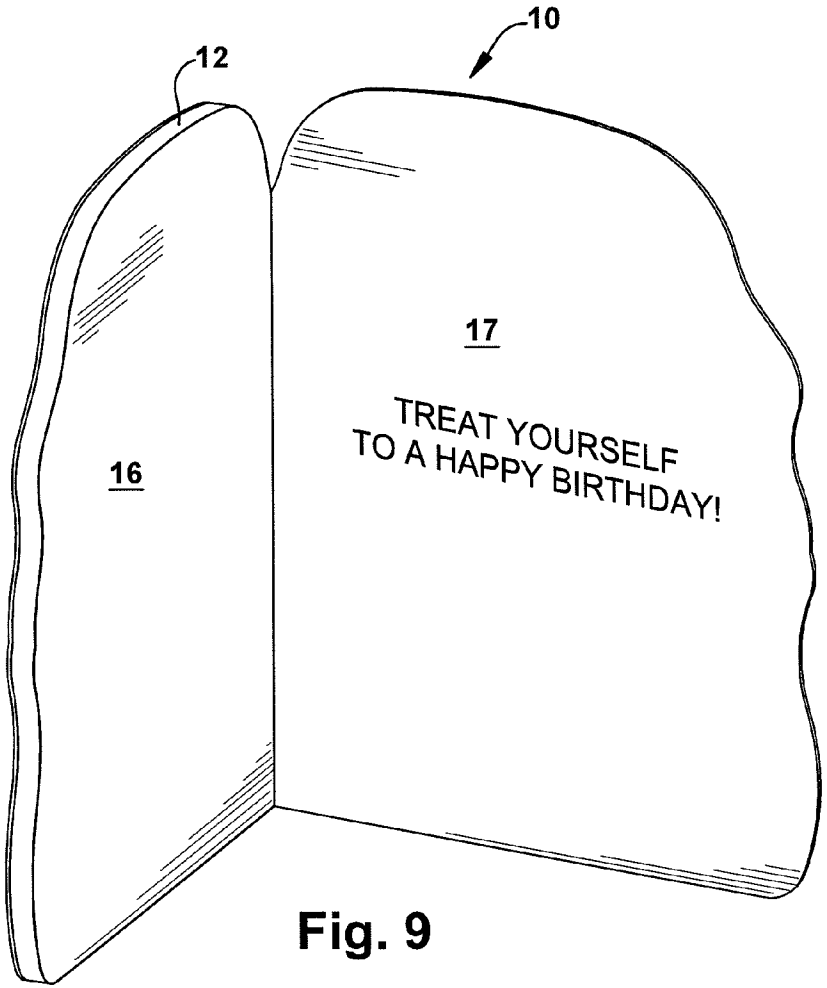
FIG. 9 is a perspective view of the three-dimensional foam greeting card of FIG. 8 in an open position.
Figure 8:
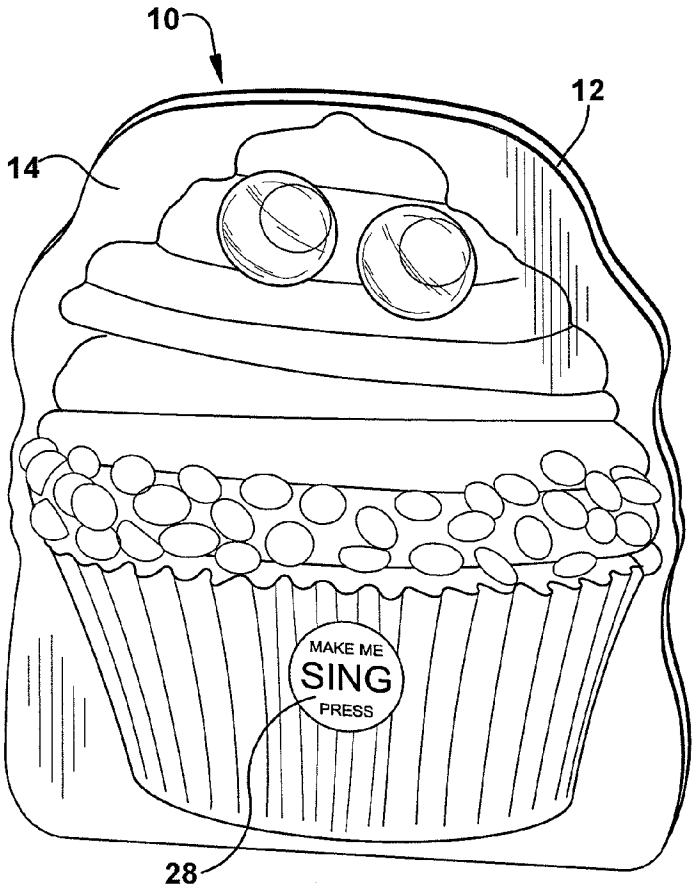
FIG. 8 is a front view of an alternate embodiment of the three-dimensional foam greeting card of the present invention in a closed position.

In one foam, a three-dimensional foam greeting card according to the present invention contains a foam body made of a hardened foam or foam-like material which makes the greeting card very lightweight. A representative example is shown in FIGS. 1-4. The foam body 12 of the greeting card 10 can be formed into any shape or profile, examples of which include, but are not limited to: a circle, a cupcake, a candle, an animal, a person, a baby carriage, a Christmas tree, a pumpkin, or any other conceivable shape. Or the greeting card 10 may take on a square or rectangular shape of a traditional greeting card. A portion of the foam body 12 is hollowed out to accommodate a device, examples of which include, but are not limited to: a sound module (shown in FIG. 4), a light module, a motor module, a multimedia player device or any combination thereof. There may be multiple cavities formed in the foam body 12 to receive multiple devices or device components such as batteries, switches, circuit boards, speakers, motors, recording devices, etc. The front and back surfaces of the foam body 12 are generally planar and can be covered with a heavy gauge paper-like material such as paper, cardboard, cardstock, or any other sheet or planar material. The outer paper-like surface 14, 16 can be cut in the shape of the foam body 12 and pre-printed with a design consistent with the shape of the foam body 12. The front surface 14 may bear decoration consistent with a front view of the item and the back surface 16 may contain decoration consistent with the back view of the item. For example, if the foam body and outer cover contain the shape and decoration of a dog, the front cover of the foam greeting card may contain the right side profile of the dog and the back cover may contain the left side profile of the dog. The outer surfaces 14, 16 are adhesively or otherwise attached to the foam body 12. The greeting card 10 may contain, in addition to the three-dimensional foam body 12 with planar front 14 and back 16 surfaces, a sentiment panel 17, which may be connected to the planar sheet material located on either the front 14 or back 16 surface of the foam body 12. This configuration is shown in FIGS. 8 and 9. The sentiment panel 17 may be, as shown, shaped in the same way as the foam body 12 and corresponding front 14 and back 16 sheet materials. If the sentiment panel 17 is connected along a fold line to the planar sheet material located on the front surface 14 of the foam body 12, it would serve as an outside front cover and an inside left panel of the greeting card 10. In a closed position, the sentiment panel 17 would be folded over the front surface 14 of the foam body 12 revealing only the outer surface of the sentiment panel 17. In an open position, it would be folded away from and revealing the front surface 14 of the greeting card 10 and the inner surface of the sentiment panel 17. Text sentiment and/or printed photographs or graphics may be contained on both the inside and outside surface of the sentiment panel. If the sentiment panel is connected along a fold line to the planar sheet material located on the back surface 16 of the foam body 12, as is shown in FIG. 9, it would serve as an outside back cover of the greeting card 10 and an inside right panel of the greeting card 10. In a closed position, the sentiment panel 17 would be folded over the back surface 16 of the greeting card 10. In an open position, it would be folded away from the back surface 16 of the greeting card 10 revealing the back surface 16 of the greeting card 10 and the inner surface of the sentiment panel 17. The three-dimensional greeting card 10 may additionally contain a display arm 18 attached to the back surface 16 of the greeting card 10, as shown in FIG. 3. The display arm 18 may be made out of cardboard or other rigid material. The upper portion of the display arm 18 is creased along a fold line 20 so that the display arm 18 may bend outward to function as a support for the greeting card 10, allowing the greeting card 10 to be displayed in a standing position.

Figure 4:
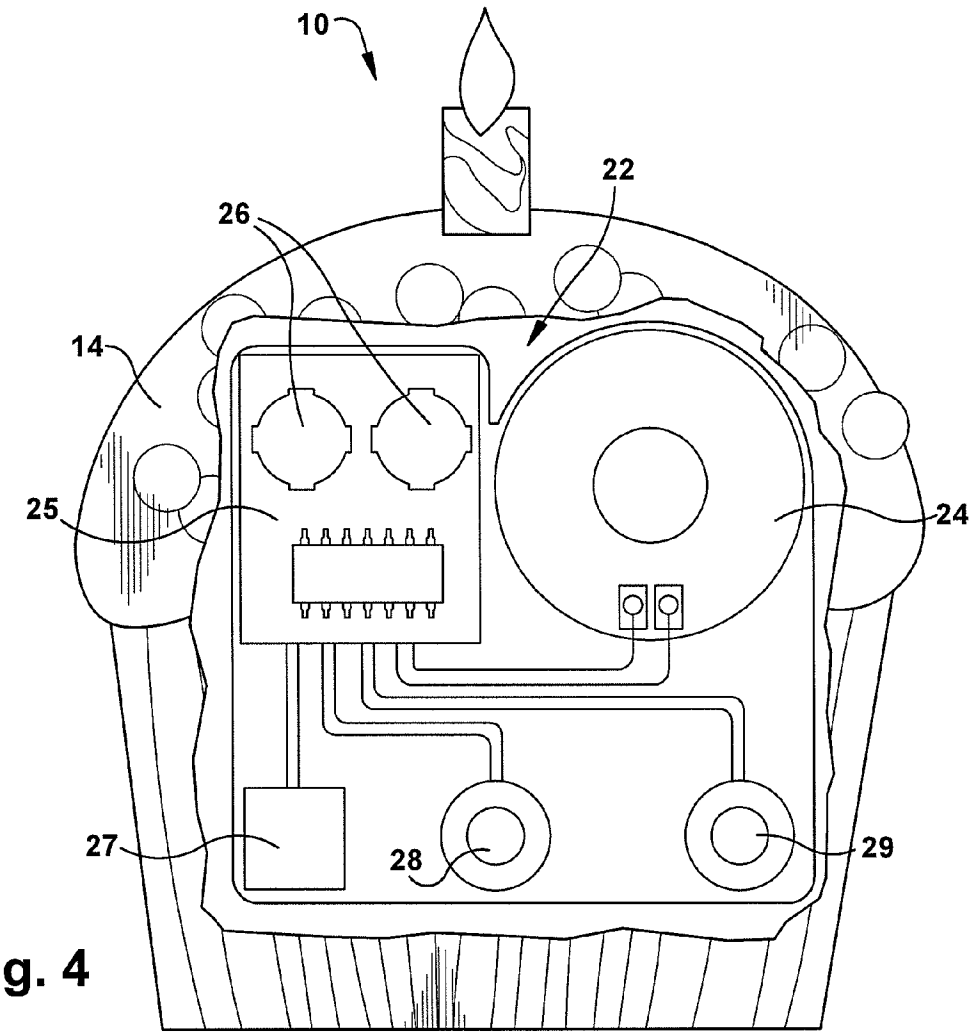
FIG. 4 is a front internal view of the three-dimensional foam greeting card of FIG. 1.

In another embodiment, the foam greeting card, as described above, may contain a sound module 22, as shown in FIG. 4. Components of the sound module may include a circuit board 25, an integrated circuit, a microprocessor, a speaker 24, a memory module, a power source 26, a switch 28, and any other components necessary to trigger and playback a pre-recorded digital audio file. The digital audio file may contain music, singing, a voice message, or any other recordable sound. Components of the sound module 22 may be contained and concealed within a hollowed out portion of the foam body 12. The switch 28 which triggers playback of the audio file may be an electro-mechanical push-button switch 28. This type of switch may be implemented as a press-button 28, wherein each time a user presses the button, playback of the audio file is initiated. A sticker or printed label may be placed above the press-button switch on the outer surface 14 of the greeting card 10 to indicate that this is the area the user must press to playback the audio file. The sticker or printed label may simply say "play" or "press here". Alternatively the surface of the greeting card 10 above the press-button may be printed with words and/or indicators to designate the location of the push-button 28. The switch may alternatively be a mechanical on/off switch which may be located on the front or back surface of the foam greeting card or it may also be located along the perimeter of the foam body 12. A slide trigger switch may also be used to initiate playback of the pre-recorded digital audio file. This type of switch may be particularly used with a foam greeting card having a sentiment panel, as described above, attached to the front or back surface of the greeting card. A slide switch mechanism may be placed over a fold line between the sentiment panel and the foam body such that when the greeting card is opened by moving the sentiment panel away from the foam body, the slide trigger activates the pre-recorded audio. Other switch mechanisms may be used such as light sensitive switches, motion sensitive switches, touch sensitive switches, pressure sensitive switches, thermal switches, moisture or capacitive switches or any other switch which would be known to one skilled in the art.

Figure 1:
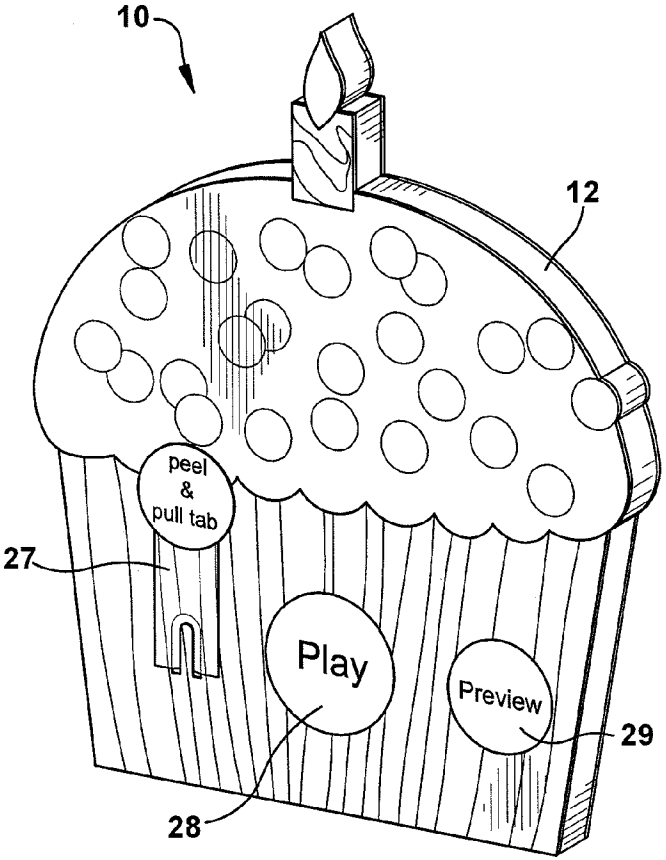
FIG. 1 is a perspective view of a first embodiment of the three-dimensional foam greeting card of the present invention.

In another embodiment, the three-dimensional foam greeting card, as described above, contains both a sound and recording module that provide the user with the ability to record a personalized message to the card recipient. As shown in FIGS. 1 and 4, this embodiment may include at least two electro-mechanical switches 28, 29 to initiate a recording session and a playback session and a microphone. A first switch 28 or "play" button, which may be implemented as a push-button switch as described above, may in a first mode initiate playback of a pre-recorded message instructing the user how to record a personal message and in a second mode initiate playback of the user's personal message. A second switch 29, or "preview" button, which may also be implemented as a push-button, may initiate a recording session wherein the user may record a personal message to the greeting card recipient. A third switch 27 or pull tab is located on the outer surface of the greeting card. This third switch 27 controls whether the greeting card 10 is in a first mode, wherein a user can test the card functionality by recording and previewing the recorded message without the ability to play the message a second time or to hear the message upon pressing the "play" button, or a second mode, wherein the user has purchased the greeting card, and removed the pull tab 27 thereby permitting the user to record a message which is then saved within the sound module and is thereby available for playback upon pressing the "play" button 28. The third switch or pull tab 27 may be located on the outer surface of the greeting card 10 so that is visible to the purchaser. While the pull tab 27 is still intact, pressing the "play" button will initiate playback of a pre-recorded voice message instructing the user how to record a personal message. Once the pull tab 27 has been removed, pressing the "play" button 28 will initiate playback of the user-recorded message. Pressing the "preview" button 29 initiates a recording session, regardless of whether the pull tab 27 has been removed or not. The recording session will continue as long as the user continues pressing or holding down the "preview" button 29 or until the amount of storage allotted for the user-recorded message has been exhausted. Once the user has finished recording the personal message, the personal message will automatically be played back. In the first mode, when the pull tab 27 is still intact, the user-recorded message is played back once and discarded, disabling further playback of the user-recorded message. In the second mode, once the pull tab 27 has been removed, the user-recorded message is immediately played back and saved so that it can be re-played by pressing the "play" button 28. The user may record over a previous message simply by pressing the "preview" button 29 and recording a new message which will overwrite the previously saved user-recorded message. The "preview" button 29 may be indicated on the outer surface of the greeting card by a removable sticker or label. Once the user purchases the greeting card and has recorded a satisfactory message, he/she can remove the "preview" sticker or label before sending the greeting card to the recipient.

Figure 6:
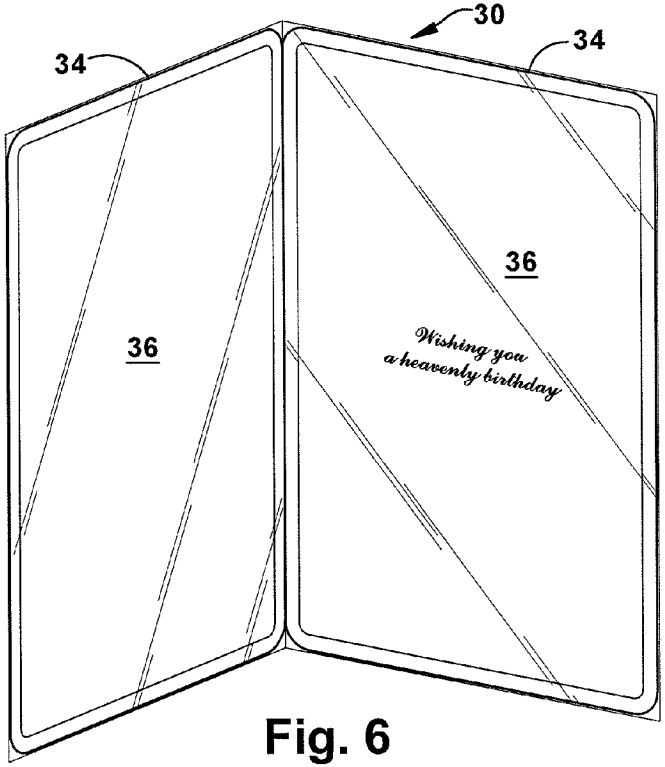
FIG. 6 is a perspective view of the three-dimensional foam greeting card of FIG. 5 in an open position.
Figure 7:
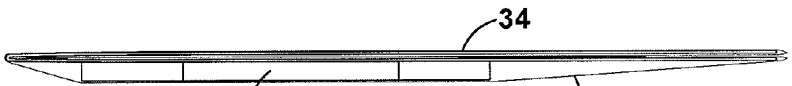
FIG. 7 is a top view of the three-dimensional foam greeting card of FIG. 5 in the direction of arrows 7-7.
Figure 5:
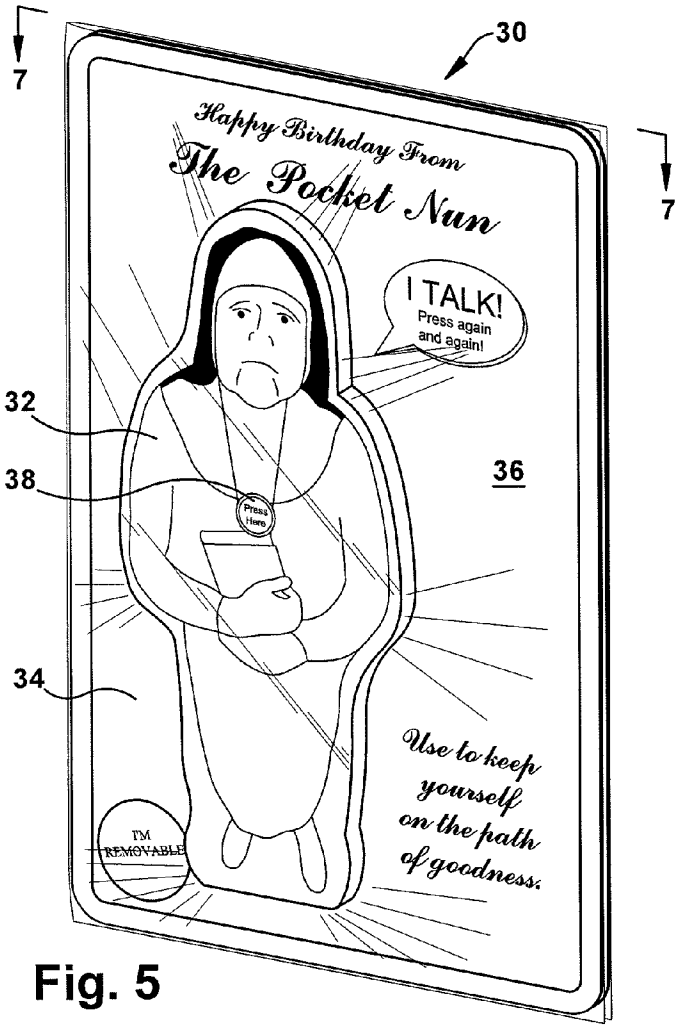
FIG. 5 is a perspective view of an alternate embodiment of the three-dimensional foam greeting card of the present invention in a closed position.

In another form, the three-dimensional foam greeting card of the present invention may be paired with a traditional paper greeting card, such as is shown in FIGS. 5-7. In this embodiment, the removable foam greeting card 32 may serve as a keepsake or token once the paper greeting 34 has been discarded. As shown in FIGS. 5-7, a sealed clear or transparent sleeve 36 made of plastic or other such material is used to pair the separate foam structure 32 and paper greeting card 34 in the same package. The foam structure 32 may be inserted into the sleeve 36 in front of the paper greeting card 34 so it is visible when looking at the greeting card 30 on a greeting card display. Alternatively, the foam structure 32 may be placed on the inside of the paper greeting card 34 to be discovered by the card recipient upon opening the greeting card 30. The foam structure 32 may contain sound, recording, light, motor, multimedia module, or combinations thereof as described in further detail below. As shown in the representative embodiment, the removable foam structure 32 contains a press button 38 which controls activation of an internal sound module, similar to the sound module shown in FIG. 4. Depression of the press button 38 may initiate playback of a pre-loaded audio file containing a voice message, music, sound, or any other digital recording.

Figure 11:
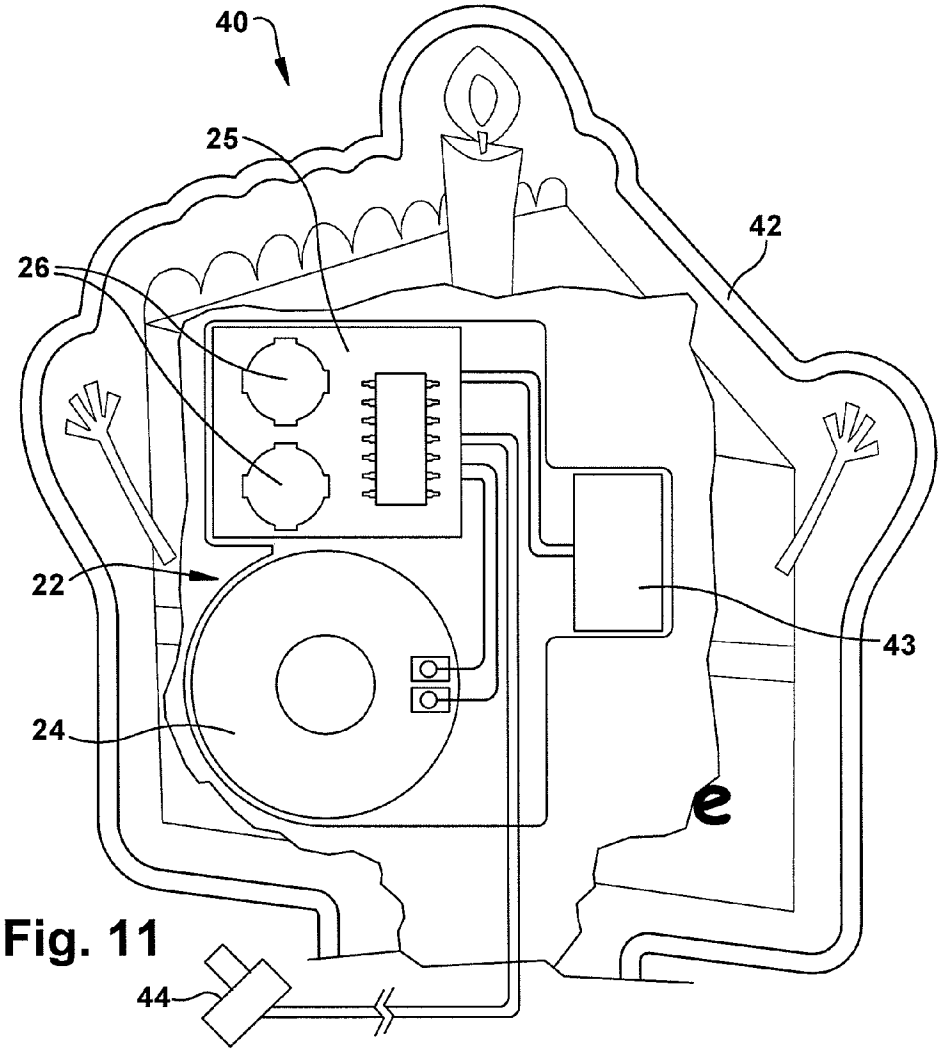
FIG. 11 is an internal view of a portion of the three-dimensional foam greeting card of FIG. 10.
Figure 10:
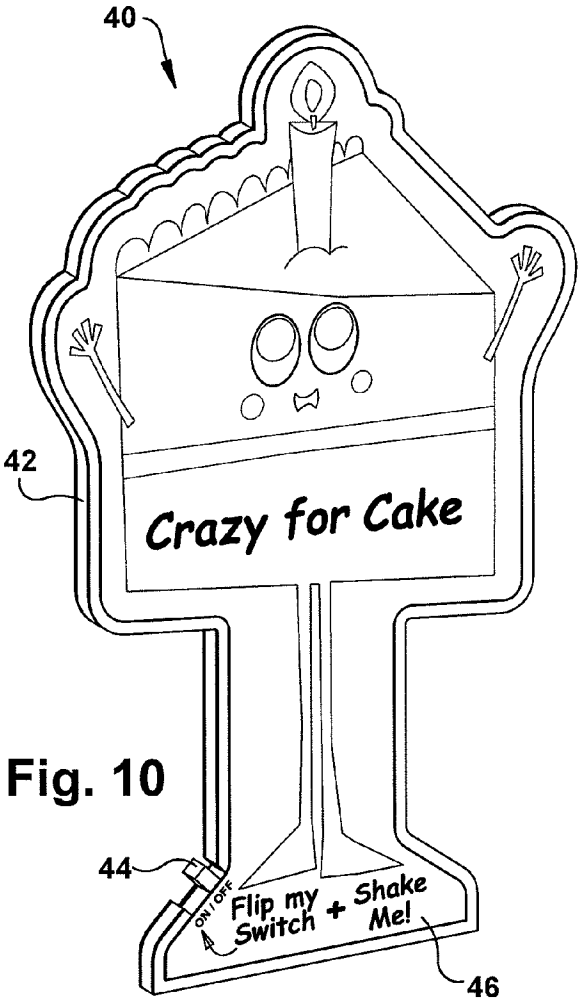
FIG. 10 is a perspective view of an alternate embodiment of the three-dimensional foam greeting card of the present invention.

The three-dimensional foam greeting card with sound, as described above, can additionally contain a motion sensor which operates to trigger one or more pre-loaded audio files. A representative example is shown in FIGS. 10-11. In this embodiment, in additional to the sound module 22 as described above, contains a motion sensor 43 within the cavity in the foam body 42. The motion sensor 43 can be used, in one embodiment, to trigger playback of a first pre-loaded audio file. In another embodiment, a first pre-loaded audio file may be played upon activating a first switch such as a push button switch or toggling a mechanical on/off button 44, as shown in FIGS. 10-11. After the first pre-loaded audio file is played back, movement of the foam body 42 activates the motion sensor 43, which triggers a second pre-loaded audio file. For example, the greeting card 40 may contain instructions to "shake me" 46 so that when the user begins to shake the foam body 42, the motion sensor 43 triggers playback of a pre-loaded audio file.

In another embodiment, the three-dimensional foam greeting card of the present invention may contain a light module with integrated LED lights. The light module would contain A light strand may be stored within a hollowed out portion of the greeting card body between the front and back surfaces of the card. The lights may be programmed to strobe in sequence or blink randomly. Different light colorations may be used as well. Other types of lighting, such as ribbon LED lights may also be used. An electro-mechanical push-activated switch may be used to allow the user to control whether the lights are turned on or off. Also, the lights may be used in combination with pre-recorded sound or a user-recorded message. A single switch may initiate playback of a pre-recorded or user-recorded message as well as turning the lights on or the audio playback and lights may be controlled by different switches.

In yet another embodiment, the three-dimensional foam greeting card of the present invention may contain a motor module located in the hollowed cavity in the foam located between the front and back panels of the greeting card. The motor module causes movement of at least one mobile object associated with the greeting card. The movement may be up and down motion, side to side lateral motion, or any other reciprocating motion. The motor module may contain a rotating gear mechanism that when activated turns a circular gear which is attached at one end to the mobile object. The mobile object can be any three dimensional object which extends outward from the front surface of the greeting card body. Activation of the motor module, which can be by a push button switch, slide switch, or any other switching mechanism, causes movement of the mobile object. Other novelties may be attached to the outside surface of the foam body such as moving eyes or other decorative embellishments.

Figure 13:
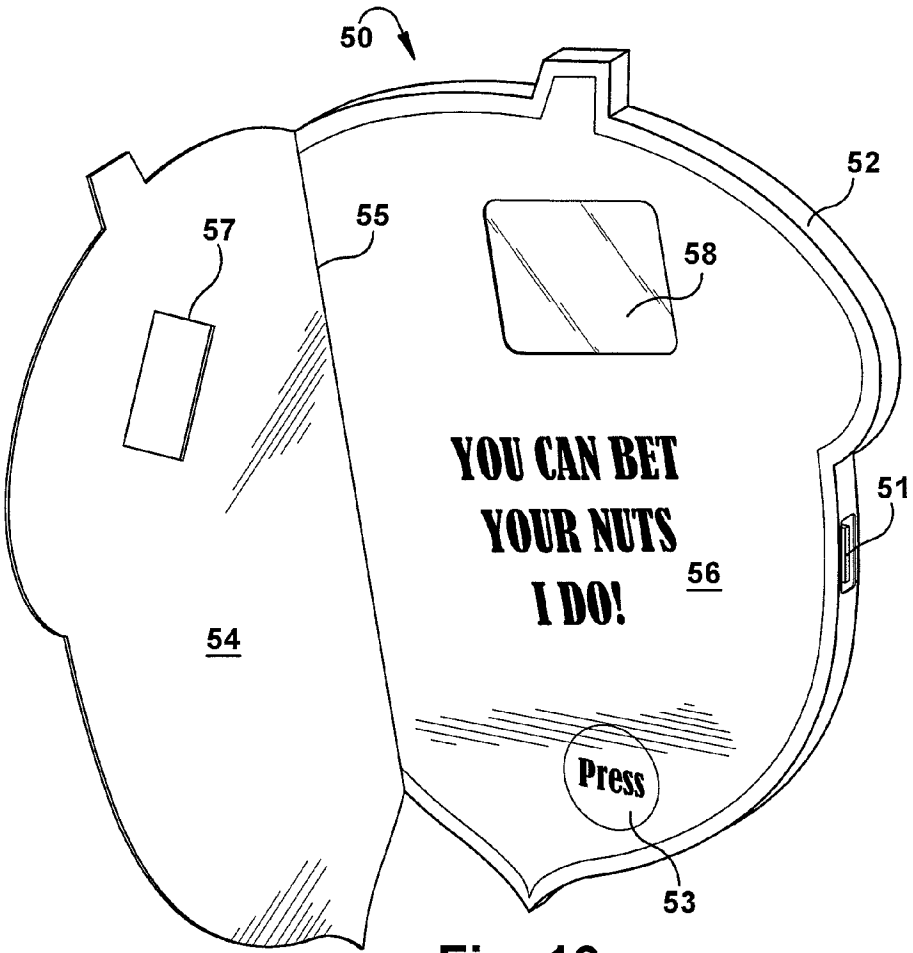
FIG. 13 is a perspective inside view of the three-dimensional foam greeting card of FIG. 12 in an open position.
Figure 12:
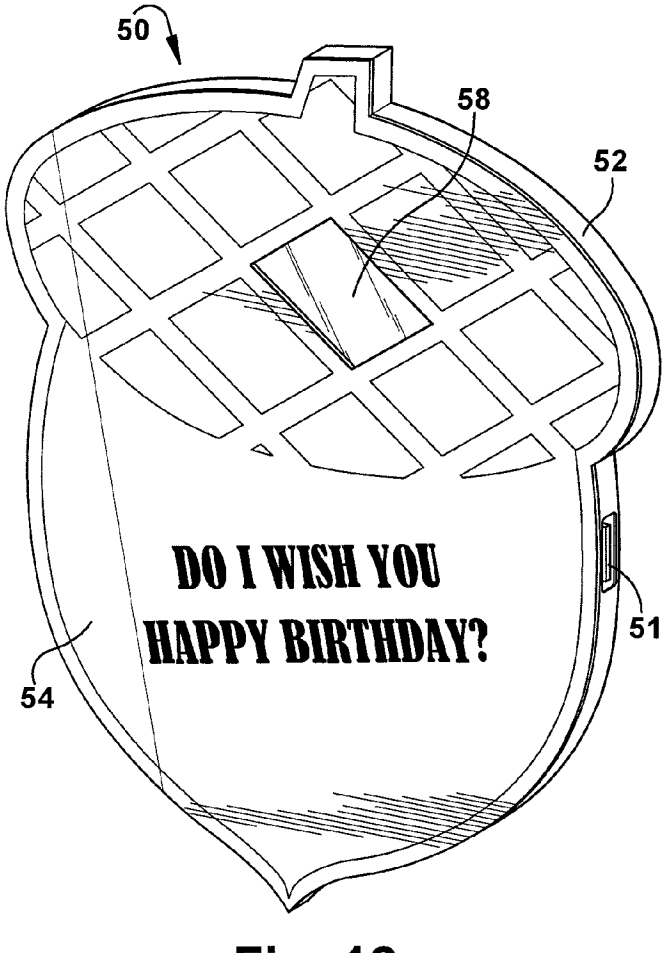
FIG. 12 is a perspective view of an alternate embodiment of the three-dimensional foam greeting card of the present invention in a closed position.

In still another embodiment, the three-dimensional foam greeting card of the present invention may be operative to play pre-loaded video and/or audio recordings. In this embodiment, a representative example of which is shown in FIGS. 12 and 13, a multimedia player device is contained within the hollowed cavity in the foam body 52 located between the front and back panels of the greeting card 50. The multimedia player device may be capable of displaying pre-loaded images or video and emitting sound. Components of such multimedia player device may include, but are not limited to, a flat panel display screen 58, such as an LCD screen, a power source which preferably consists of one or more disposable batteries, an audio speaker, integrated circuit, a circuit board with microprocessor, a data storage device and related circuitry. The device may contain at least one pre-recorded slideshow with accompanying pre-recorded digital audio files. A representative device may store up to approximately 20 pre-loaded photos or images and between approximately 26 seconds to 2.26 minutes of audio or greater, depending on the amount of digital storage provided. The device, when powered by four disposable lithium batteries, is capable of playing the pre-loaded audio/visual content approximately 300 times. Representative width and/or height dimensions of a display screen 58 are between approximately 1.5 and 2.4 inches. The screen 58 may be visible through an opening in the planar sheet material located on the front surface 56 of the foam body 52. The foam greeting card body 52 may additionally contain a sentiment panel 54, as described above, which is attached along a fold line 55 to the planar sheet material attached to the front surface 56 of the foam body 52. The sentiment panel 54 would serve as the front cover of the greeting card 50 and in a closed position, lay atop the sheet material attached to the front surface 56 of the foam body 52. The sentiment panel 54 may also contain an opening thereon 57, consistent with the opening for the display screen 58 contained on the planar sheet material located on the front surface 56 of the foam body 52, through which the display screen 58, contained within the foam body 52, is visible. The multimedia display device may be activated by a push button switch 53 located on the front or back surface of the foam body 52. The greeting card 50 may contain the words "play" printed above the push button switch 53 which indicates where the multimedia player device is activated. Alternatively, the greeting card 50 may contain a slide switch which is used in combination with a sentiment panel 57, as described above. The slide switch may be located across a fold line 55 between the sentiment panel 54 and the foam greeting card body 52, such that when the greeting card 50 is opened or the sentiment panel 54 is folded away from the greeting card body 52, the slide switch works to activate the multimedia player. The greeting card 50 may additionally contain a mechanical on/off switch or button which controls whether or not the multimedia player device may be activated. The on/off switch may be located along the side perimeter of the foam body 52 between the planar sheet material located on the front and back surfaces of the foam body or it may be located on the front or back surface of the greeting card body.

A further embodiment of the three dimensional foam greeting card with multimedia player device, as described directly above, may contain audio recording capabilities which would provide a user with the ability to record a personalized message to be played before, during or after the pre-recorded slideshow is displayed on the display screen. Additional components such as a sound and recording module, as described above with reference to a previous embodiment, would accompany the multimedia player device within the cavity located within the foam body between the front and back panels of the greeting card. The multimedia player device may contain one or more pre-recorded audio files that may be played before during or after the personalized user recorded message.

Further still, the three dimensional foam greeting card with multimedia player device may additionally include a USB port 51, SD slot or any other appropriate external memory input source so that a user may upload digital video, digital photos and/or digital audio files to be presented on activation of the multimedia device. The multimedia device may be capable of playing several file formats including, but not limited to, flash, html, html5, mp3, mp4, .mov, .rp4, /wma, etc. The multimedia player device may also contain one or more pre-loaded digital video, photo and/or audio files which may be played in combination with the user uploaded digital video, photo and/or audio. The video, slideshow and/or audio may be triggered by any of the switch mechanisms described herein and playback may further be controlled by a mechanical on/off switch. The switch mechanisms may be located on the front or back of the greeting card or along the side perimeter of the foam structure.

Figure 15:
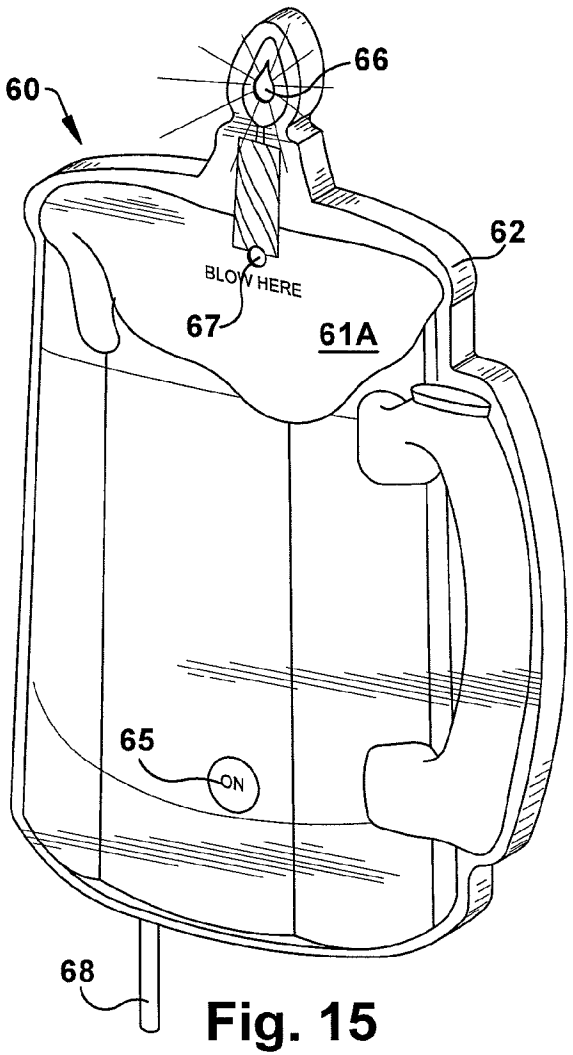
FIG. 15 is a perspective view of the interactive cake topper of FIG. 14.
Figure 14:
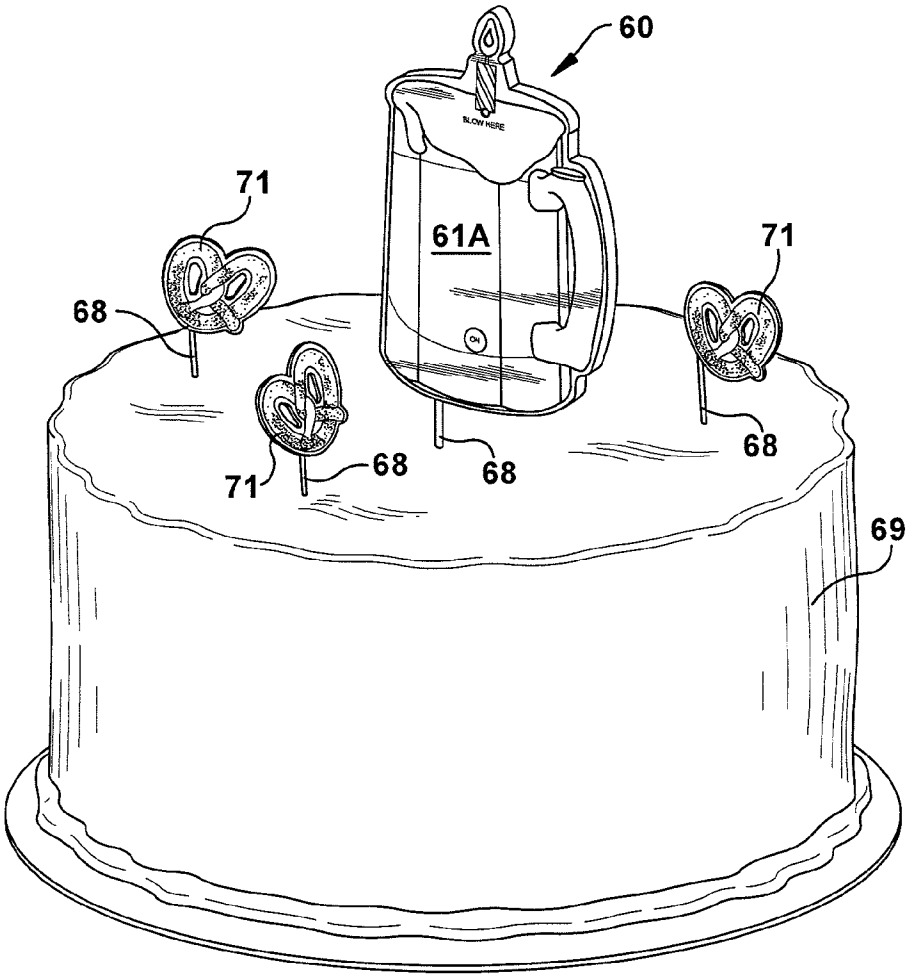
FIG. 14 is a perspective view of an interactive cake topper embodiment of the present invention, atop of a cake.
Figure 16:
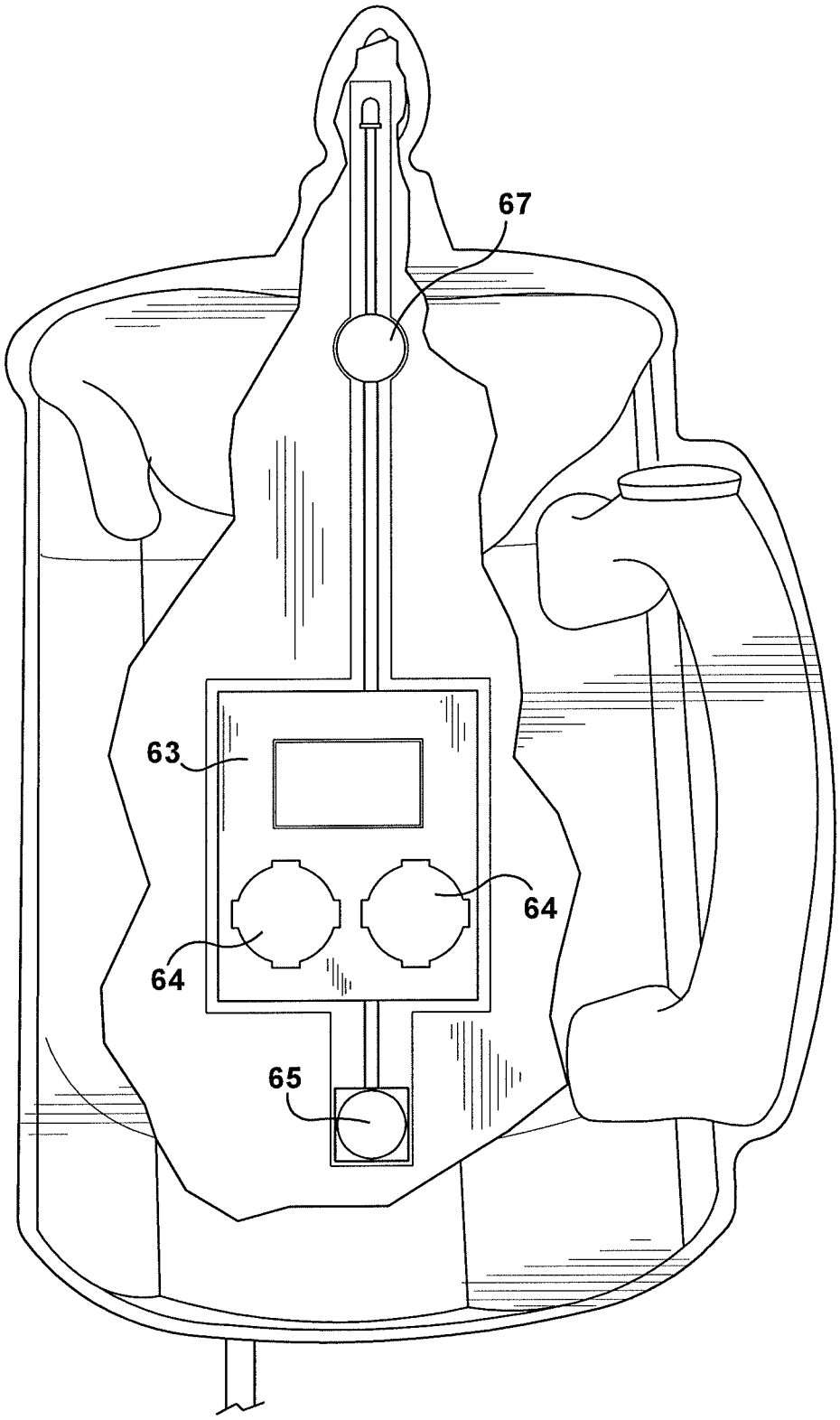
FIG. 16 is a tear-away view of the interactive cake topper of FIG. 14.
Figure 17:
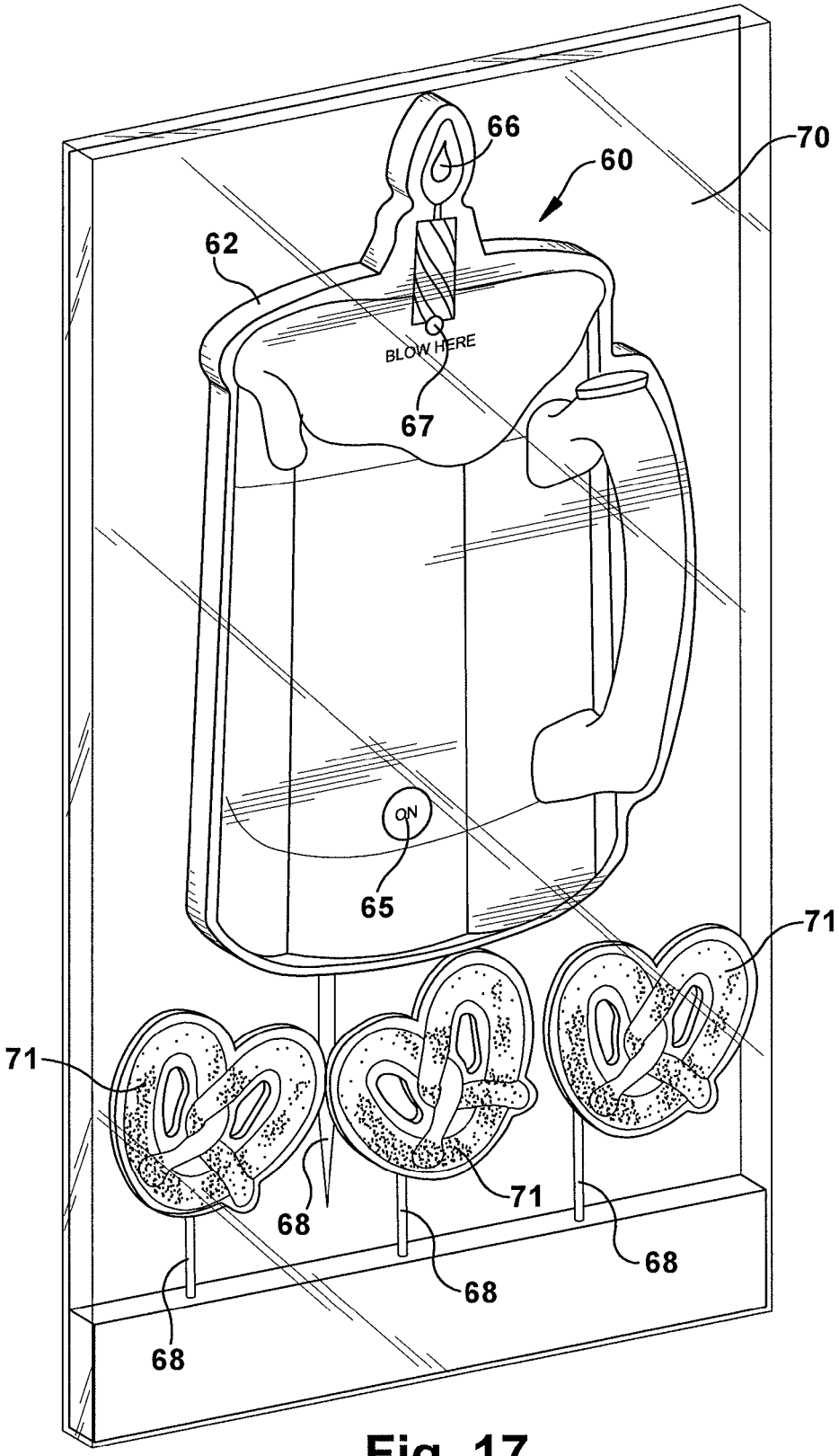
FIG. 17 is a perspective view of the interactive cake topper of FIG. 14, with packaging.

Another embodiment of the present invention is shown in FIGS. 14-17. In this embodiment, a three-dimensional foam body serves as an interactive cake topper 60 having light and sound capabilities. As described above with respect to the foam greeting card embodiments, a three-dimensional foam body is made of hardened foam or other foam-like material which makes the body very lightweight. The foam body 62 can be formed into any shape or profile, such as, for example, a mug of beer with a candle on top, as shown in FIGS. 14 and 15. The foam may also take a more traditional shape, such as a square, rectangle, or circle. A portion of the foam body 62 is hollowed out to accommodate one or more electronic or other devices, examples of which include, but are not limited to: a sound module, a light module, a motor module, a multimedia player device or any combination thereof. Additional devices or device components such as batteries, switches, circuit boards, speakers, motors, recording devices, etc. may also be contained within a hollowed out portion of the foam body. The foam 62 may have a single cavity or hollowed out portion or may have multiple cavities for storing the above-mentioned or other devices and/or device components. The front and back surfaces of the foam body 62 are generally planar and can be covered with a heavy gauge paper-like material 61 such as paper, cardboard, cardstock, or any other sheet or planar material. The outer paper-like surface 61 can be cut in the shape of the foam body 62 and pre-printed with a design consistent with the shape of the foam body 62, such as the beer mug, as shown in FIGS. 14 and 15. The front surface may bear decoration consistent with a front view of the item and the back surface may contain decoration consistent with the back view of the item. For example, in the embodiment shown in FIG. 15, the foam body 62 is shaped like a beer mug, the front cover material 61A shows a front view of a beer mug and the rear cover material 61B shows a rear view of the beer mug. The outer surfaces 61A, 61B are adhesively or otherwise attached to the foam body 62 and they conceal the cavity or cavities within the foam body 62 and the device and/or device components contained therein. The perimeter of the foam body 62, which extends between the front and back surface of the foam body 62, may be left uncovered, such that the foam is visible around the edges of the front and back surfaces, as shown in the Figures. Alternatively, the perimeter may be covered by the same paper-like surface as the front and back surface of the foam or any other material. As mentioned above, one or more electronic devices may be contained within one or more cavities in the foam body. In this embodiment, the cake topper 60 contains a sound module operative for playing sound, a light module operative to illuminate one or more lights, and one or more sensors for controlling playback of said sound and activation of said light. Components of the sound module may include, but are not limited to: a circuit board 63; an integrated circuit; a microprocessor; a speaker; a memory device; a power source 64; a switch; and any other components necessary to store, trigger and playback pre-recorded digital audio. The digital audio file may contain music, singing, a voice message, or any other recordable sound. In a preferred embodiment, a press button switch 65 is used to initiate playback of a first audio clip and also to illuminate one or more miniature lights 66, such as LED lights, which are contained within the foam body 62 and visible through an opening thereon and through the front cover material 61A. One such light, as shown in FIG. 15, represents the flame of a candle. When the press button switch 65 is pushed and the one or more lights 66 illuminated, the light representing the candle flame may flicker and fade simulating a burning or lit candle. Other lights, which may be smaller than the light representing the candle flame, may also be programmed with various lighting effects including, but not limited to: blinking (repetitive on/off); twinkling (two or more lights with fast alternating blink); and slow glow (starts as dim light that progressively gets brighter). Different timing patterns may also be used with various lighting effects. Alternatively, the press button switch may illuminate only the light which represents the candle flame. The press button switch 65 may be accessed through the front surface of the foam body (and planar sheet material) with the area of the press button 65 indicated by printed text, a sticker or other such indicator. The first audio clip, initiated by the press button switch 65, may be, for example, spoken words instructing the user to "blow the candle out". The audio may also contain accompanying music. An air pressure activation sensor switch or blow sensor 67 is located proximate to the light 66 representing the candle flame. The blow sensor 67 is located within the one or more cavities in the foam body 62 and accessed through an opening in the foam body 62 and the front cover material 61A. Printed text may indicate ("blow here") where the user should direct his/her breath when "blowing out the candle". Once the blow sensor 67 detects a user's breath on the sensor, it extinguishes the one or more lights 66 and initiates a second audio clip, which may be a song, music or spoken word. In a preferred embodiment, when the user blows on the specially indicated blow sensor 67 ("blows out the candle"), the second audio clip is triggered initiating the sound of clapping or applause. The process can be repeated by again pushing the press button 65 which will again illuminate the one or more lights 66 and initiate the first audio clip. As mentioned above, if the press button switch 65 illuminates the single light which represents the candle flame, the blow sensor 67 may extinguish the light representing the candle flame and illuminate one or more other lights visible through the front surface of the foam body 62. One or more (preferably two) dowels or rods 68 are inserted into the perimeter of the foam body 62 along a bottom edge. A significant portion of the dowels or rods 68 are contained on the outside of the foam body 62 and serve as an anchor for the topper 60 when inserted into a cake 69. The decorative effects, such as the printing contained on the front 61A and back 61B cover material, the lights 66 and the audio clips may all be coordinated to represent a particular theme. The cake topper 60 may be packaged at retail in a clear or transparent plastic case 70 which completely encloses the cake topper 60, as shown in FIG. 17. The plastic container 70 protects the cake topper 60 from becoming damaged but still allows a potential buyer to view the product. One or more decorative accents 71 may be included along with the cake topper 60 within the retail package 70. For example, as shown in FIG. 17, one or more smaller foam bodies 71 covered with front and back cover material, having a single dowel or rod 68 contained therein for placing alongside the cake topper 60 atop a cake 69 or other confection may be included. The decorative accents 71 may complement or be coordinated with the theme of the cake topper 60. For example, in the embodiment shown in FIG. 17, the main cake topper 60 is shaped and decorated to represent a mug of beer. The smaller decorative accents 71 are shaped like pretzels to complement the beer mug and maintain the theme of the cake topper 60. The smaller decorative accents 71 may have different shapes and designs or they may be identical. While the examples shown and described herein contain a particular shape, such as the beer mug with candle, other shapes, sizes, themes and decorative effects have been contemplated and are considered to be within the scope of the present invention. Also, the interactive cake topper 60 may only include lights but not sound, or may include a motor which drives a moveable component, or any combination of the above mentioned electronic modules. The embodiments shown and described are intended as examples only and are not meant to limit the invention in any way.

Figure 19:
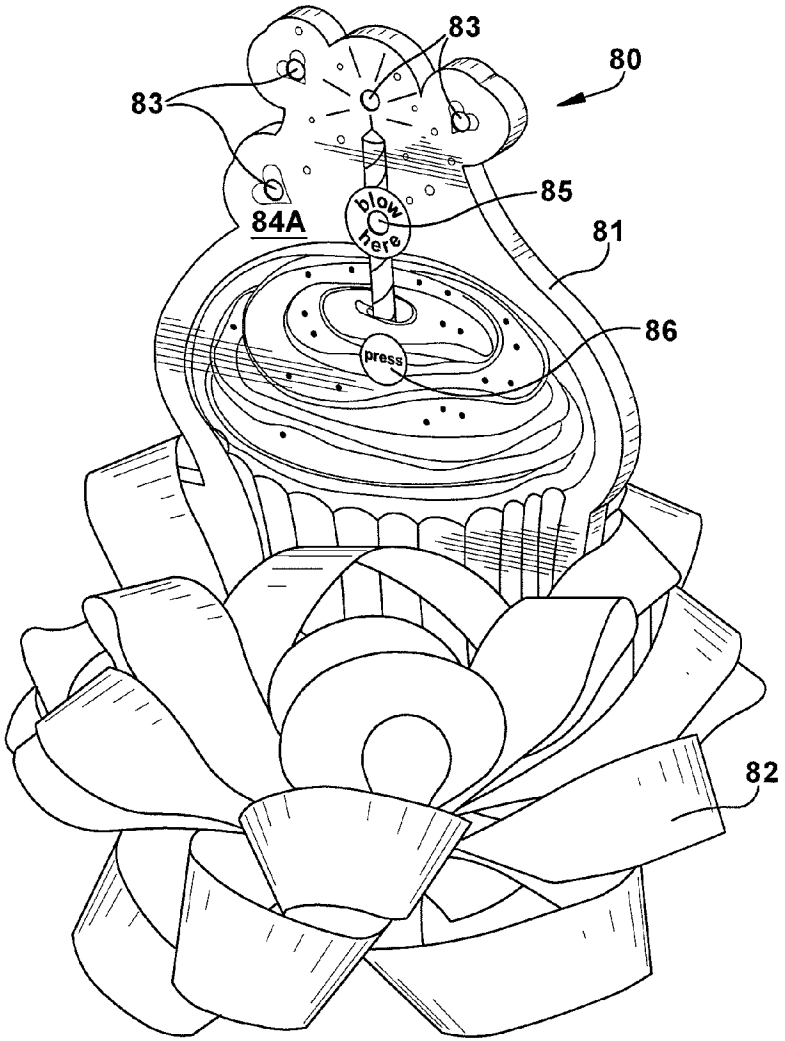
FIG. 19 is a perspective view of the interactive gift accessory of the present invention.
Figure 18:
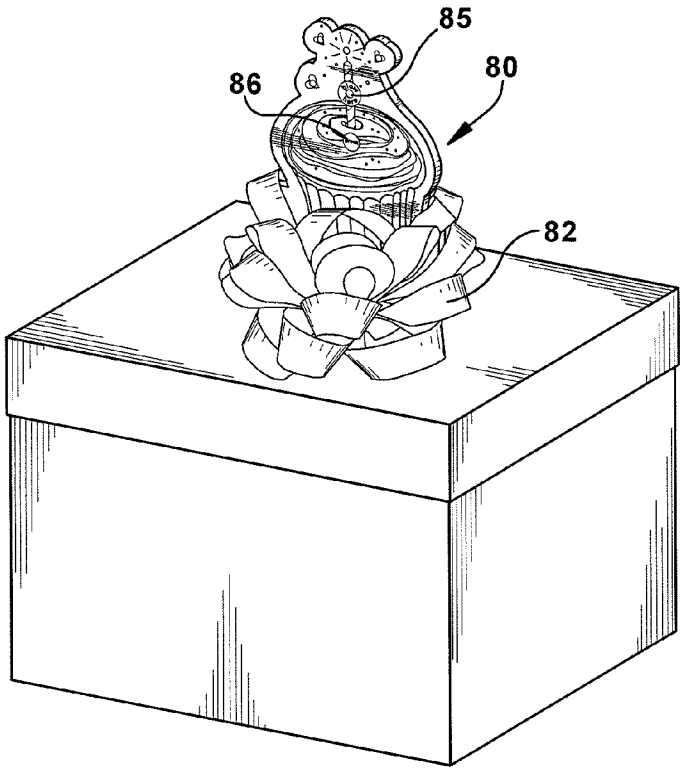
FIG. 18 is a perspective view of an interactive gift accessory embodiment of the present invention, atop a gift box.

In another embodiment, shown in FIGS. 18 and 19, a three-dimensional foam body 81 serves as an interactive bow 80 or gift package accessory. In this embodiment, a foam body 81 as described above with reference to the interactive cake topper 60, is attached to a bow, ribbon or other gift package topper or accessory 82. As described above, the foam body 81 contains one or more cavities therein for storing and concealing electronic or other components. These components include, but are not limited to: a light module; a sound module; a motor module; one or more switches or sensors, a speaker, a circuit board, an integrated circuit chip, a memory device, a power source, such as one or more disposable batteries. In this embodiment, the foam body 81 contains one or more miniature lights 83, such as LED lights that are visible through an opening in the foam body 81 and also in the front cover material 84A. One such LED light 83 is shown at the top of a candle, which is printed on the front cover material 84A, to represent the flame of a candle. An air pressure activation sensor or blow sensor 85 is also contained within the foam body 81 with the blow sensor 85 being exposed through an opening in the foam body 81 and front cover material 84A proximate to the LED light representing the candle flame. A press button switch 86 is also located within the foam body 81 and can be accessed through the front of the foam body 81 and the front cover material 84A. Printing may indicate where the press button 86 is located and also where the user must blow to activate the blow sensor 85. As described above, pushing the press button causes illumination of the one or more miniature lights 83 and may also optionally initiate playback of an audio clip. The audio clip may tell the user to "blow out the candle" or may play music, a song or other sound. When the user blows on the specially placed sensor 85 (proximate to the miniature light indicating the candle flame), the lights 83 are extinguished and a second, optional, audio clip may be played back. Once the second, optional audio has been played, the user may repeat the process by again pushing the press button 86. The foam body 81 is attached to a gift package adornment 82, such as the bow shown in FIG. 19. In a preferred embodiment, the foam body 81 is attached to the center of the bow 82 and is configured in an upright or standing arrangement. The foam body 81 may be attached to the bow 82 via adhesive, staples, or any other attachment device. Alternatively, a base may be attached directly to the bow 82, the base having an elongate channel for accommodating the foam body 81 in an upright or standing configuration. The foam body 81 may be inserted into the channel on the base and may be attached thereto via a friction fit or by adhesive or other attachment mechanism. However, the gift package accessory may be a ribbon, a flower or any other decorative effect which may serve as a base for the interactive foam body 81. While the example shown in the figures contains an interactive three dimensional foam body shaped like a cupcake with candle therein, the foam may be shaped and decorated like any other item. The embodiments presented herein are meant as examples and are not intended to limit the invention in any way.

The three-dimensional foam greeting cards of the present invention may also contain a battery-saving device which includes a small substantially rectangular plastic insert which is inserted into a small slot in the foam body. The slot is located directly outside the location of a battery circuit switch which is contained on the circuit board inside the foam body. When the device is inserted into the slot the circuit is opened, preventing batteries from draining while the product is not in use. When the device is removed, the circuit closes, and the batteries are activated, allowing the user to record a message, play an audio clip, light up the greeting card or cause components of the greeting card to be put in motion.

It should be noted that the three-dimensional foam greeting card described herein may contain one or a combination of two or more functions, as described, such as sound, light, audio, recording, motion, or multimedia functions. Additionally, a variety of switches are mentioned herein and can be used alone or in combination and may be located in a variety of locations on the three-dimensional foam greeting card.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. An interactive cake decorating kit comprising:

a foam cake topper having a front surface, a rear surface opposite the front surface, a perimeter surface extending between the front and rear surfaces, and means to insert the cake topper into a cake, the cake topper shaped like a character and having printing thereon to further resemble the character;

a light module contained within the first three dimensional foam body operative to illuminate and extinguish one or more miniature lights which are visible through the front surface of the foam cake topper;

a switch which controls activation of the one or more miniature lights and an audio clip which instructs the user to blow on a specially indicated area of the foam cake topper to extinguish the one or more miniature lights; and two or more miniature foam shapes which are complementary to the foam cake topper and which have means to insert each of the two or more miniature foam shapes into a cake surrounding the foam cake topper thereby decorating a top surface of a cake.

2. The interactive cake decorating kit of claim 1, wherein the switch is a press button switch.

3. The interactive cake decorating kit of claim 2, wherein the switch is accessed through the front surface of the foam cake topper.

4. The interactive cake decorating kit of claim 1 further comprising a second switch which is an air pressure sensor switch.

5. The interactive cake decorating kit of claim 4, wherein the second switch deactivates the one or more miniature lights upon a user blowing on the specially indicated area on the front surface of the cake topper.

6. The interactive cake decorating kit of claim 1, wherein at least one of the one or more miniature lights is programmed to flicker like a candle.

7. The interactive cake decorating kit of claim 1, wherein a second audio clip is played upon the user blowing on the specially indicated area of the cake topper.

8. The interactive cake decorating kit of claim 7, wherein the second audio clip is recorded applause.

9. The interactive cake decorating kit of claim 1, wherein the means to insert the cake topper into a cake is one or more dowels which extend downward from the perimeter surface of the cake topper for insertion into a cake.

10. The interactive cake decorating kit of claim 1, wherein the foam cake topper and two or more miniature foam shapes are packaged together at retail in a transparent plastic case.

11. An interactive cake topper comprising:

a single three dimensional foam body having a front surface, a back surface and a perimeter surface therebetween;

a front cover material attached to the front surface of the three dimensional foam body;

a back cover material attached to the back surface of the three dimensional foam body;

a sound module operative to store and playback at lest one digital audio clip, the sound module located within the three dimensional foam body;

a light module operative to illuminate and extinguish one or more lights which are visible through an opening in the three dimensional foam body and the front cover material;

a first switch which controls activation of the light module to illuminate the one or more lights and playback of a digital audio clip which instructs the user to blow on a specially indicated area of the three dimensional foam body;

a second switch which controls deactivation of the light module to extinguish the one or more lights and playback of a digital audio clip which plays recorded applause; and at least one dowell which extends outward from the perimeter surface along a bottom edge of the cake topper;

two or more foam shapes having at least one dowel extending outward from a perimeter surface along a bottom edge of the two or more foam shapes, the two or more foam shapes being designed and decorated to compliment the three dimensional foam body and to decorate the top surface of a cake.

12. The interactive cake topper of claim 11, wherein the second switch is an air pressure sensitive switch.

13. The interactive cake topper of claim 1, wherein the air pressure sensitive switch initiates deactivation of the light module when a user blows on a specially indicated area of the cake topper.

14. The interactive cake topper of claim 11, wherein the cake topper and the two or more foam shapes are packaged together at retail in a clear transparent vase.

15. The interactive cake topper of claim 11, wherein the first switch is a press button switch.

* * * * *